US009831570B2

(12) United States Patent
Habirov et al.

(10) Patent No.: US 9,831,570 B2
(45) Date of Patent: Nov. 28, 2017

(54) TERMINAL STRIP AND TERMINAL STRIP BLOCK

(71) Applicant: PHOENIX CONTACT GMBH & CO. KG, Blomberg (DE)

(72) Inventors: Dennis Habirov, Bielefeld (DE); Torsten Schloo, Detmold (DE); Harry Bentler, Luegde (DE); Olaf Schyrocki, Bad Pyrmont (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/121,396

(22) PCT Filed: Jan. 26, 2015

(86) PCT No.: PCT/EP2015/051477

§ 371 (c)(1),
(2) Date: Aug. 25, 2016

(87) PCT Pub. No.: WO2015/128135

PCT Pub. Date: Sep. 3, 2015

(65) Prior Publication Data

US 2016/0372846 A1 Dec. 22, 2016

(30) Foreign Application Priority Data

Feb. 27, 2014 (DE) ..... 10 2014 102 602

(51) Int. Cl.
*H01R 9/22* (2006.01)
*H01R 9/26* (2006.01)
(Continued)

(52) U.S. Cl.
CPC ..... *H01R 9/2608* (2013.01); *H01R 9/2633* (2013.01); *H01R 9/2666* (2013.01);
(Continued)

(58) Field of Classification Search
CPC .. H01R 9/2608; H01R 25/168; H01R 9/2625; H01R 9/2666; H01R 9/2633; H01R 27/02; H01R 13/02; H01R 4/2433; G01R 1/0416
(Continued)

(56) References Cited

U.S. PATENT DOCUMENTS 4,851,967 A * 7/1989 Gerke ..... G01R 1/0416 361/823
6,196,862 B1 * 3/2001 Dooley ..... H01R 4/2433 361/119
(Continued)

FOREIGN PATENT DOCUMENTS

DE 102008014177 A1 9/2009
DE 102008014179 A1 9/2009
(Continued)

OTHER PUBLICATIONS

Reihenklemmen Clipline, Jan. 2011, Phoenix Contact GmbH & Co. KG, 2011, pp. 25, 192, 196, 540, 541.
(Continued)

*Primary Examiner* — Jean F Duverne
(74) *Attorney, Agent, or Firm* — Leydig, Voit & Mayer, Ltd.

(57) ABSTRACT

A terminal strip for latching onto a mounting rail includes a terminal housing that has a first connection side and a second connection side and a busbar arranged in the terminal housing. At least two conductor connection elements are arranged in the terminal housing. The conductor connection elements each connect at least one conductor to the busbar. Each conductor connection element has a first function shaft having at least one plug-in connection receiving region and at least a second function shaft having at least one screw-connection receiving region arranged on each of the two connection sides of the terminal housing. One connection region is formed for each plug-connection receiving region and for each screw-connection receiving region in the busbar. The function shafts of one connection side are arranged in a manner spaced apart from one another.

7 Claims, 5 Drawing Sheets

(51) Int. Cl.
*H01R 27/02* (2006.01)
*H01R 25/16* (2006.01)

(52) U.S. Cl.
CPC ..... *H01R 9/2675* (2013.01); *H01R 25/168* (2013.01); *H01R 27/02* (2013.01)

(58) Field of Classification Search
USPC ..... 439/722
See application file for complete search history.

(56) References Cited

U.S. PATENT DOCUMENTS

| | | | | |
|---|---|---|---|---|
| 8,998,654 | B2 * | 4/2015 | Donhauser | H01R 13/02 439/709 |
| 9,407,019 | B2 * | 8/2016 | Falk | H01R 9/2608 |
| 9,456,518 | B2 * | 9/2016 | Bury | H05K 7/1472 |
| 2011/0014808 | A1 | 1/2011 | Diessel | |
| 2011/0059658 | A1 | 3/2011 | Eisert et al. | |
| 2011/0062011 | A1 | 3/2011 | Pollmann | |
| 2014/0329397 | A1 | 11/2014 | Schloo et al. | |
| 2015/0147907 | A1 | 5/2015 | Goerlitzer et al. | |
| 2015/0255896 | A1 * | 9/2015 | Niemann | H01R 9/2625 439/121 |

FOREIGN PATENT DOCUMENTS

| | | | |
|---|---|---|---|
| DE | 102008014176 | B4 | 1/2011 |
| DE | 102010052871 | A1 | 6/2012 |
| DE | 102011113333 | A1 | 3/2013 |
| DE | 102012010244 | A1 | 11/2013 |
| WO | WO 2013167253 | A1 | 11/2013 |

OTHER PUBLICATIONS

German Office Action, German Patent Office, dated Nov. 10, 2014, pp. 1-6.

* cited by examiner

TERMINAL STRIP AND TERMINAL STRIP BLOCK

CROSS-REFERENCE TO PRIOR APPLICATIONS

This application is a U.S. National Phase application under 35 U.S.C. §371 of International Application No. PCT/EP2015/051477, filed on Jan. 26, 2015, and claims benefit to German Patent Application No. DE 10 2014 102 602.0, filed on Feb. 27, 2014. The International Application was published in German on Sep. 3, 2015 as WO 2015/128135 A1 under PCT Article 21(2).

FIELD

The invention relates to a terminal strip for latching onto a mounting rail. The invention further relates to a terminal strip block.

BACKGROUND

Electric terminal strips have been known for decades and are used in their millions in the wiring of electrical systems and equipment. The terminal strips are usually latched onto mounting rails which for their part are frequently arranged in a plurality in a switch cabinet. Screw terminals or spring-cage terminal blocks are mainly used as conductor connection elements in terminal strips. However, insulation displacement terminals or leg spring terminal blocks can also be used in addition.

The basic type of terminal strip is the connecting terminal with at least two conductor connection elements which are joined to each other electrically by way of an electrically conductive connection rail, the busbar. In addition to this basic type, which is also often referred to as a feed-through terminal block, there are many different types of terminal strips which are specifically adapted to the respective application. Protective conductor terminals, disconnect terminals and test terminals are mentioned as examples.

Particularly in the case of terminal strips, which are used in current transformer measuring circuits in power generation, transmission and distribution, various switching, disconnecting and testing tasks frequently have to be implemented. For this there are various accessories, such as test plug sockets, fixed bridges or switching jumpers, which can be mounted in terminal strips and electrically connected to the busbar. Using fixed bridges, it is possible in this case to implement distribution of potential between adjacent terminal strips in a simple manner. Switching jumpers are used to join two or more adjacent terminal strips electrically to one another as required so that there is an option to short-circuit a connected current transformer.

SUMMARY

A terminal strip for latching onto a mounting rail includes a terminal housing that has a first connection side and a second connection side and a busbar arranged in the terminal housing. At least two conductor connection elements are arranged in the terminal housing. The conductor connection elements each connect at least one conductor to the busbar. Each conductor connection element has a first function shaft having at least one plug-in connection receiving region and at least a second function shaft having at least one screw-connection receiving region arranged on each of the connection sides of the terminal housing. One connection region is formed for a respective plug-connection receiving region and for a respective screw-connection receiving region in the busbar. The function shafts of one connection side are arranged in a manner spaced apart from one another such that at least one plug connection is receivable in the first function shaft and at least one screw connection is receivable in the second function shaft simultaneously on one connection side.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
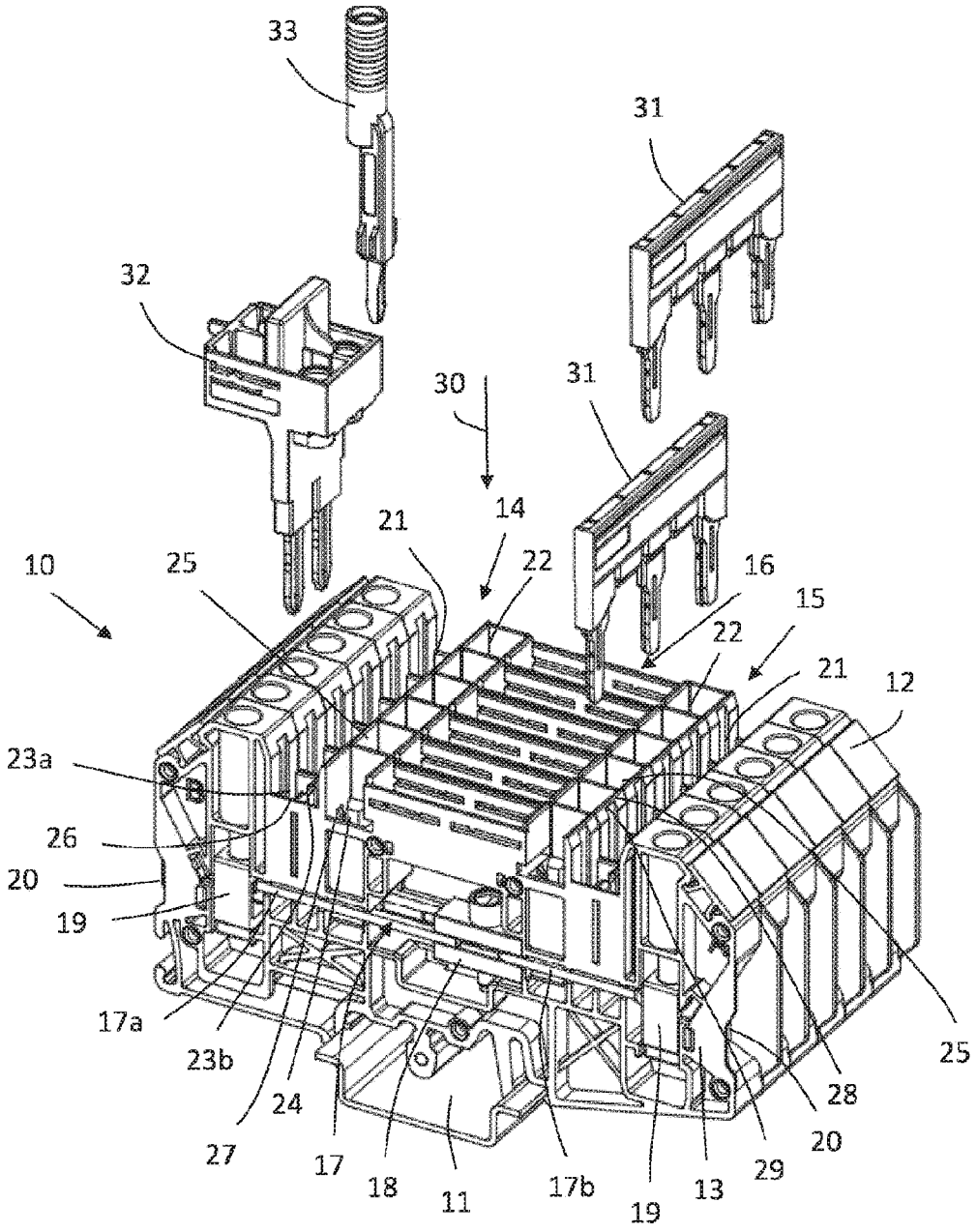
FIG. 1 is a schematic perspective view of a terminal strip block formed from a plurality of terminal strips with a plurality of not yet mounted plug connections.

The terminal strip according to the invention comprises a terminal housing having a first connection side and a second connection side, a busbar arranged in the terminal housing and at least two conductor connection elements arranged in the terminal housing for connecting in each case at least one conductor to the busbar, in each case a first function shaft having at least one plug-connection receiving region and at least a second function shaft having at least one screw-connection receiving region being arranged on each of the two connection sides of the terminal housing, one connection region being formed for each plug-connection receiving region and for each screw-connection receiving region in the busbar, the function shafts of one connection side being arranged in a manner spaced apart from one another such that at least one plug connection is receivable in the first function shaft and at least one screw connection is receivable in the second function shaft simultaneously on one connection side.

The terminal strip according to the invention renders it possible for one or more plug connections and one or more screw connections to be arranged simultaneously on the function shafts of one connection side in electrical contact with the busbar. By now having the option to connect one or more plug connections and one or more screw connections parallel to each other on the connection sides of the terminal housing, it is possible to significantly increase functionality compared to conventional terminal strips in which it is only ever possible to arrange one or more plug connections or one or more screw connections per connection side in electrical contact. As a result, it is also possible to increase the flexibility of the terminal strip since a user can assemble the terminal strip with screw connections and plug connections, according to requirements and application, without being restricted to a combination of plug connections and screw connections. For this purpose, the first function shaft with at least one plug-connection receiving region and the second function shaft with at least one screw-connection receiving region are arranged with a sufficiently large gap between one another per connection side, such that the plug connections and the screw connections can be inserted and mounted in the respective function shafts or the respective receiving regions of the function shafts of a connection side without obstructing one another. The plug connections can be arranged quickly and with minimum effort in the plug-connection receiving regions such that the plug connections can be used to form a quickly modifiable connection. The user thus has the opportunity to take a terminal strip that may have been partially pre-assembled and re-assemble it flexibly with plug connections. The screw connections in the screw connection regions may already have been assembled by the manufacturer, such that it is possible to use the screw connections to form connections which can be permanently installed.

It is preferably provided that, between the first function shaft and the second function shaft of a connection side, a partition plate is arranged at least transverse to the longitudinal extension of the terminal strip, the partition plate preferably being mounted on an edge of the function shafts. The partition plate thus preferably at least forms an extension to a wall of the function shafts, it being possible to mold the partition plate preferably directly onto a wall of the function shafts having said edge. The partition plate therefore preferably overhangs the edge of the function shafts. The partition plate is preferably mounted on the edge of the function shafts at the point where the function shafts are open and the plug connections and/or screw connections can be inserted into the respective function shaft. The partition plate can increase the clearances and creepage paths between the function shafts. In addition, the partition plate can extend a guide, in particular of a plug connection, beyond the wall of the function shafts, such that depending on the length of the partition plate, said partition plate can be used to form a guide for a plug connection over a large part or over the entire length of said plug connection. As a result of the improved guide, it is possible, for example, to prevent tilting of a plug connection in the plug-connection receiving region of a first function shaft. In addition, the partition plate can also create a visual separation of the function shafts of a connection side, such that the partition plate makes it visually easier to distinguish the different function shafts of a connection side from one another.

The partition plate can have a lead-in chamfer to make insertion, particularly of a plug connection into a plug-connection receiving region of a function shaft, even easier. The lead-in chamfer is preferably formed on an upper end of the partition plate in the plug-in direction of a plug connection in a plug-connection receiving region. The lead-in chamfer can preferably have an angle of 45°.

The partition plate can also preferably have a guide groove. The guide groove can preferably be brought into engagement with a guide bar formed on a plug connection, such that when inserting a plug connection into a function shaft of the plug connection, said plug connection can be inserted safely and selectively into the function shaft via the guide bar engaging in the guide groove of the partition plate without the risk of the plug connection tipping. For example, the guide groove and the guide bar can also be dovetailed.

The partition plate can extend over one or more regions of the edge of the function shafts. For example, the partition plate can be U-shaped and thus extend over three adjacent regions of the edge of the function shafts. As a result, in addition to its arrangement transverse to the longitudinal extension of the terminal strip, the partition plate can also extend in the longitudinal extension of the terminal strip. On the one hand, this can further improve guidance of the plug connection and/or of the screw connection into the guide shafts. On the other hand, the arrangement of the partition plate in the longitudinal extension of the terminal strip can also improve the clearances and creepage paths between adjacently arranged terminal strips.

For example, the terminal strip can be used in current transformer measuring circuits or voltage transformer measuring circuits, it then being possible to configure the terminal strip as a disconnect terminal or test disconnect terminal block. If the terminal strip is configured as a disconnect terminal or test disconnect terminal block, then the busbar is preferably formed from a first busbar portion assigned to the first connection side and from a second busbar portion assigned to the second connection side, it being possible to mount a longitudinal isolating switch between the two busbar portions and the two busbar portions being connected to one another in a first position of the longitudinal isolating switch and being separated from one another in a second position of said longitudinal isolating switch.

The invention also provides a terminal strip block which has at least two terminal strips, described as above, configured and further developed, which are latchable next to one another on a mounting rail.

FIG. 1 shows a terminal strip block 10 with six terminal strips 12 latched next to one another on a mounting rail 11. The terminal strips 12 are each configured in the form of disconnect terminals, which are used in particular as test disconnect terminal blocks in current transformer measuring circuits in power generation and distribution.

The terminal strips 12 each have a terminal housing 13 which is made from an insulating material, for example plastics material.

Each terminal housing 13 has a first connection region 14, a second connection region 15 and a switching region 16, the switching region 16 being formed in the longitudinal extension of a terminal strip 12 between the two connection regions 14, 15.

Arranged inside the terminal housing 13 is a busbar 17 which extends along the two connection regions 14, 15 and the switching region 16. The busbar 17 is formed from a first busbar portion 17*a* assigned to the first connection side 14 and from a second busbar portion 17*b* assigned to the second connection side 15, the two busbar portions 17*a*, 17*b* lying in one plane. In the switching region 16, a longitudinal isolating switch 18 is movably supported between the two busbar portions 17*a*, 17*b* in the terminal housing 13. FIGS. 1-6 show the longitudinal isolating switch 18 in a position in which the two busbar portions 17*a*, 17*b* are connected to one another via said longitudinal isolating switch 18 in that the longitudinal isolating switch 18 overlaps or overhangs both an end of the first busbar portion 17*a* and also an end of the second busbar portion 17*b*.

One conductor connection element 19 in each case is arranged on the two busbar portions 17*a*, 17*b* of the busbar 17, it being possible to insert one conductor in each case into the conductor connection elements 19 via the conductor insertion openings 20 formed in the terminal housing 13 in order to connect the conductors electrically with the busbar 17 using the conductor connection elements 19. In the embodiments shown in FIGS. 1-6, the conductor connection elements 19 are configured as screw connection elements.

A first function shaft 21 and a second function shaft 22 are formed on each of the two connection sides 14, 15 of the terminal housing 13. The first function shaft 21 of both the first connection side 14 and also of the second connection side 15 has in each case two plug-connection receiving regions 23*a*, 23*b* arranged one behind the other in the longitudinal extension of the terminal strip 12, into which plug-connection receiving regions one plug connection in each case can be inserted and mounted. The second function shaft 22 of both the first connection side 14 and the second connection side 15 has in each case one screw-connection receiving region 24 into which a screw connection can be inserted and mounted. The first function shaft 21 of the first connection side 14 is thus constructed in the same way as the first function shaft 21 of the second connection side 15. Furthermore, the second function shaft 22 of the first connection side 14 is thus constructed in the same way as the second function shaft 22 of the second connection side 15.

One connection region is formed for each plug-connection receiving region 23*a*, 23*b* and for each screw-connection receiving region 24 in the busbar 17, for example in the form of an opening, in the busbar 17, such that a plug connection inserted into a plug-connection receiving region 23*a*, 23*b* and a screw connection inserted into a screw-connection receiving region 24 can each be electrically connected to the busbar 17 via the connection regions.

In the terminal strips 12 shown in FIGS. 1-6, all the function shafts 21, 22 can be fitted simultaneously with plug connections or screw connections such that, for example, with two plug-connection receiving regions 23*a*, 23*b*, the first function shaft 21 of the first connection side 14 can receive one or two plug connections and the second function shaft 22 of the first connection side 14 can receive one screw connection simultaneously without the screw connection and the plug connections obstructing or interfering with one another. To achieve this, the function shafts 21, 22 of one connection side 14, 15 are spaced sufficiently far apart from one another. The two function shafts 21, 22 of a connection side 14, 15 are arranged one behind the other in the longitudinal extension of the terminal strip 12.

A partition plate 25 is arranged in each case between the two function shafts 21, 22 of a connection side 14, 15. In this case, at least one region of the partition plate 25 is arranged transverse to the longitudinal extension of the terminal strip 12. The partition plate 25 overhangs an edge 26, 27 of the function shafts 21, 22 such that the partition plate 25 forms an extension to at least one wall of the function shafts 21, 22, in that said partition plate 25 is mounted on the edge 26, 27 of said function shafts 21, 22.

The partition plate 25 has a lead-in chamfer 28 on its upper end. In addition, the partition plate 25 has a guide groove 29 which extends in the plug-in direction 30 of a plug connection.

In the embodiments shown in FIGS. 1-6, the partition plate 25 is U-shaped, said partition plate 25 extending over three adjacent regions, at an angle to one another, of the edge 26 of the first function shaft 21. As a result, in addition to its arrangement transverse to the longitudinal extension of the terminal strip 12, the partition plate 25 also extends in the longitudinal extension of said terminal strip 12.

Figure 2:
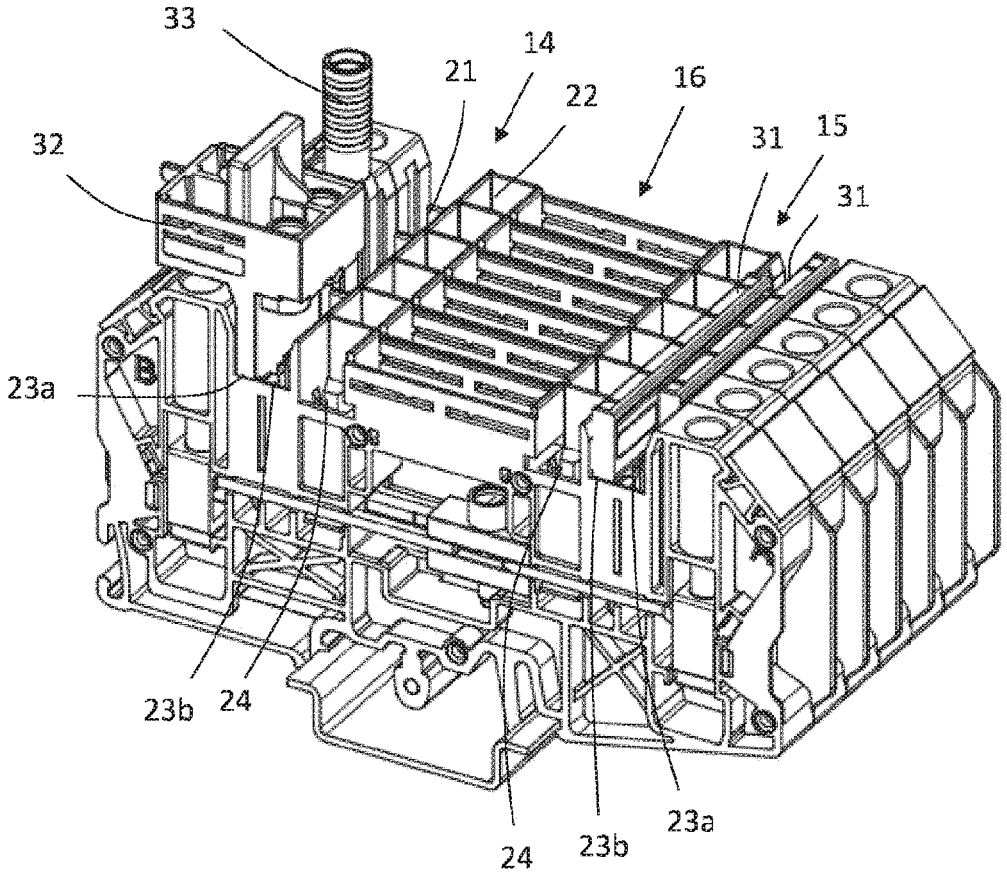
FIG. 2 is a schematic perspective view of the terminal strip block shown in FIG. 1 with mounted plug connections.

FIG. 1 shows various plug connections, in particular two plug-in bridges 31, one switching plug bridge 32 and one test plug socket 33 prior to mounting in the terminal strips 12 of the terminal strip block 10. In FIG. 2, these plug connections, the two plug-in bridges 31, the switching plug bridge 32 and the test plug socket 33 are inserted and mounted in the plug-connection receiving regions 23*a*, 23*b* of the first function shafts 21 of the two connection sides 14, 15.

Figure 3:
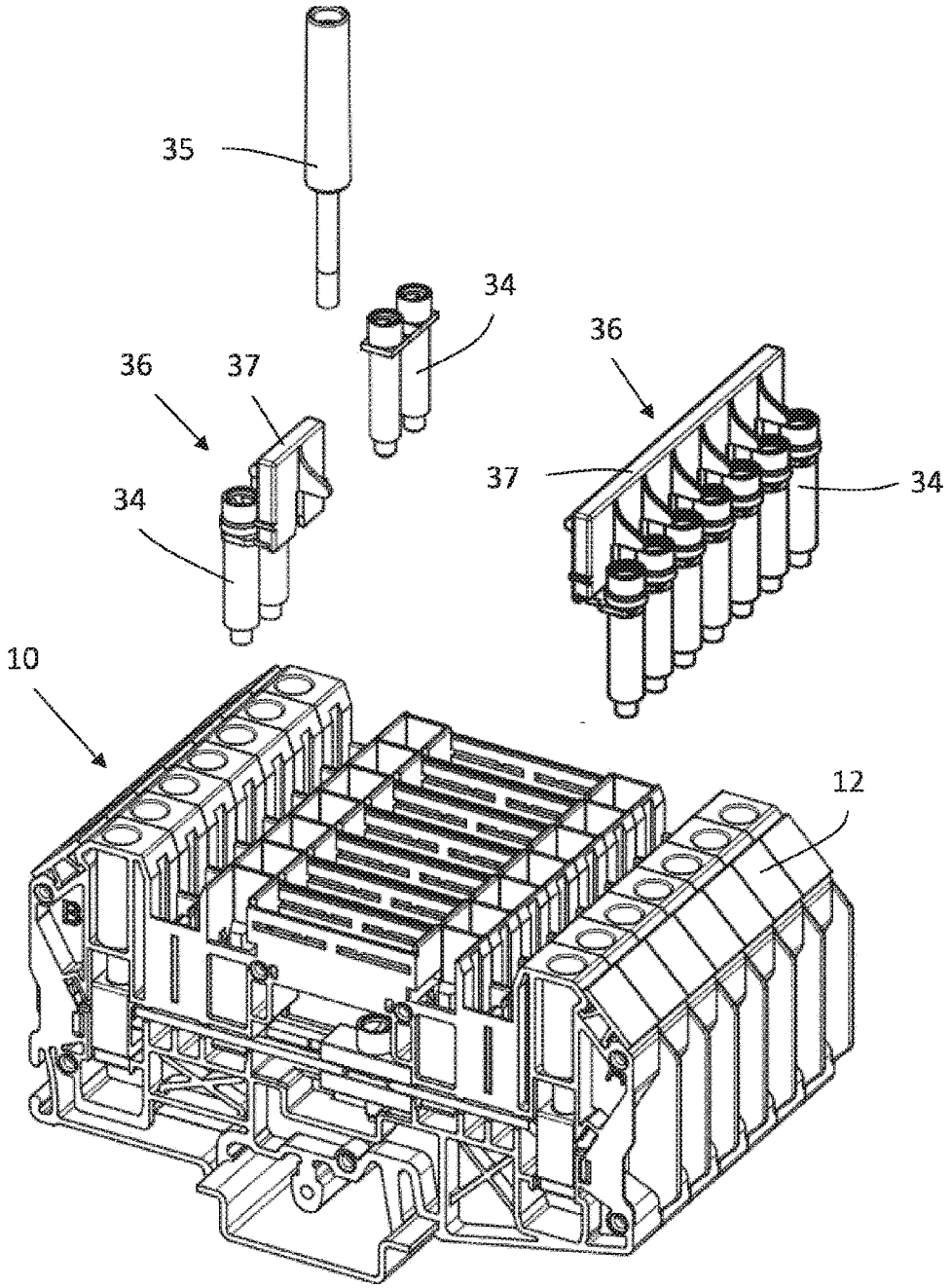
FIG. 3 is a schematic perspective view of the terminal strip block shown in FIG. 1 with a plurality of not yet mounted screw connections.
Figure 4:
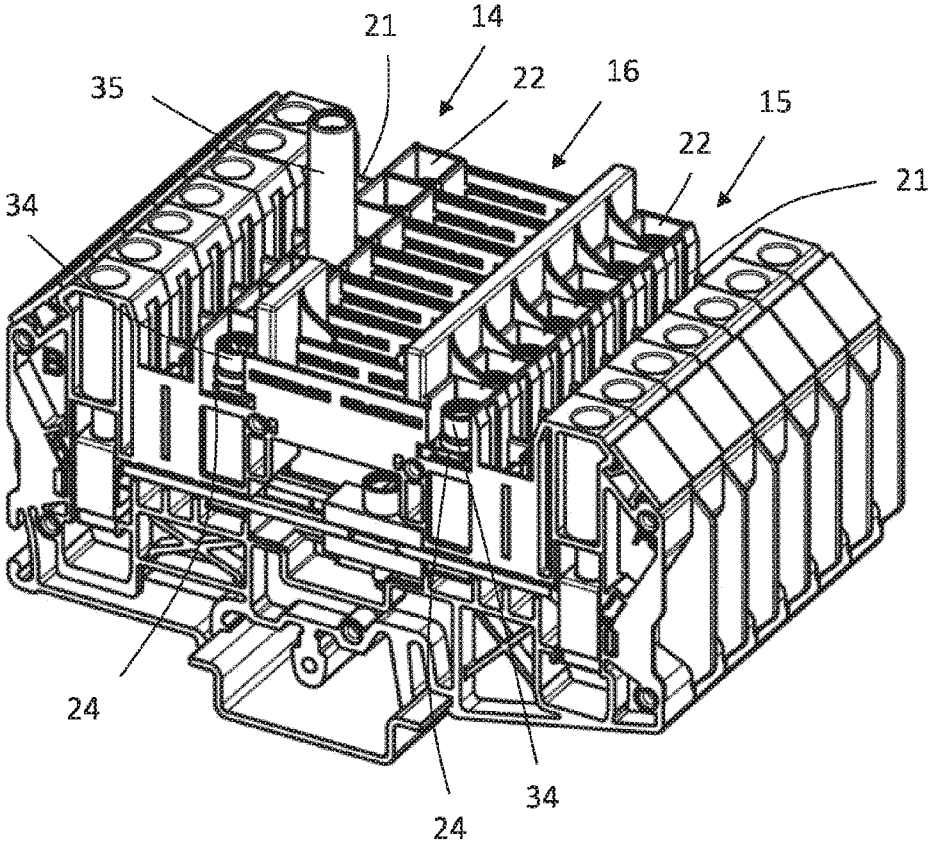
FIG. 4 is a schematic perspective view of the terminal strip block shown in FIG. 1 with mounted screw connections.

FIG. 3 shows screw connections in the form of screws 34 bridged with one another which, as shown in FIG. 4, can be screwed into the screw-connection receiving regions 24 of the second function shafts 22. Two or more screws 34 arranged in a row are configured as a switching screw bridge 36 to generate a current transformer short-circuit, the screws 34 being connected to one another in this case via a bridge comb 37. The bridge combs 37 can be opened in the terminal network and they can be latched in place in an open position. In addition, FIGS. 3 and 4 show a test socket screw 35 which can be screwed in instead of a screw 34, as is also shown in FIG. 4.

Figure 5:
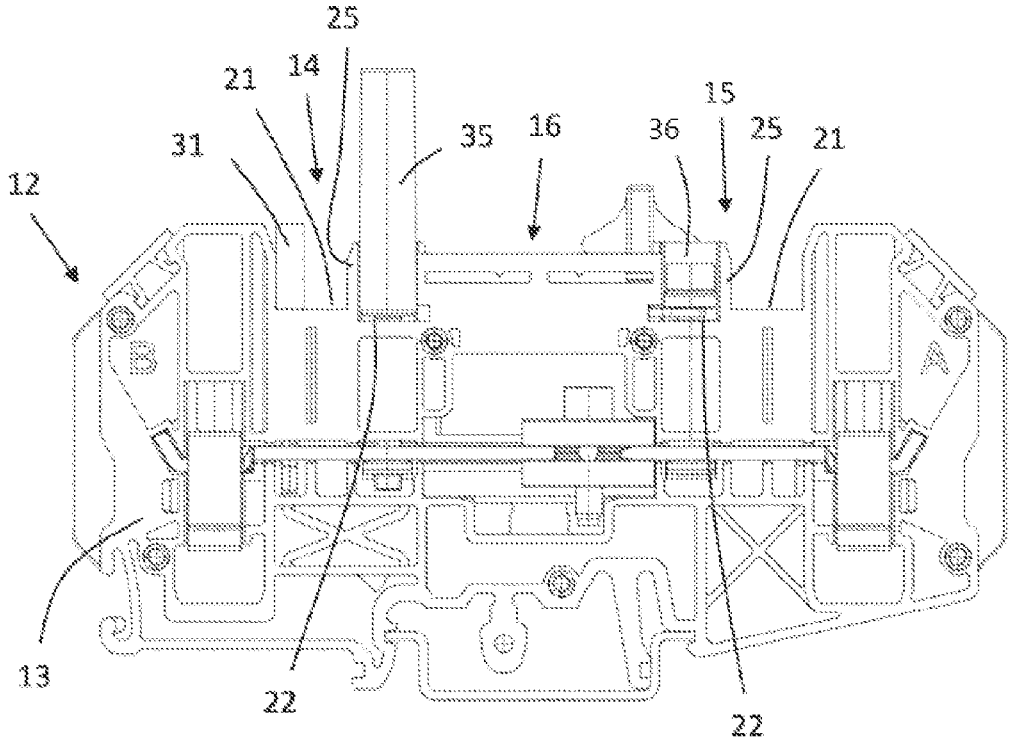
FIG. 5 is a schematic plan view of a longitudinal side of a terminal strip with plug connections and screw connections mounted on the terminal strip.

FIG. 5 shows an embodiment in which a plug connection in the form of a plug-in bridge 31 is mounted in the first function shaft 21 on the first connection side 14 and simultaneously a screw connection in the form of a test socket screw 35 is mounted in the second function shaft 22 of the first connection side 14. Only a switching screw bridge 36 is mounted as a screw connection in the second function shaft 22 on the second connection side 15.

Figure 6:
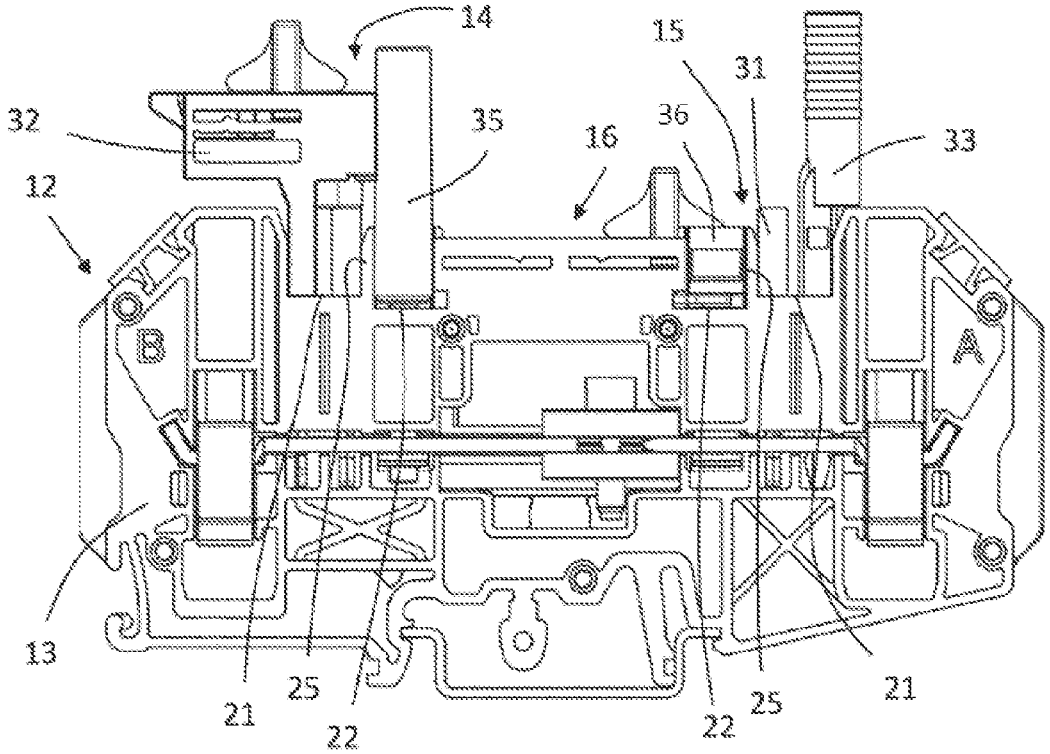
FIG. 6 is a further schematic plan view of a longitudinal side of a terminal strip with plug connections and screw connections mounted on the terminal strip.

FIG. 6 shows a further embodiment in which a plug connection in the form of a switching plug bridge 32 is mounted in the first function shaft 21 on the first connection side 14 and simultaneously a screw connection in the form of a test socket screw 35 is mounted in the second function shaft 22 of the first connection side 14. Two plug connections in the form of a plug-in bridge 31 and a plug-in test plug socket 33 are mounted in the first function shaft 21 on the second connection side 15 and simultaneously a switching screw bridge 36 is mounted as a screw connection in the second function shaft 22 of the second connection side 15.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Terminal strip block 10
Mounting rail 11
Terminal strip 12
Terminal housing 13
First connection side 14
Second connection side 15
Switching region 16
Busbar 17
First busbar portion 17*a*
Second busbar portion 17*b*
Longitudinal isolating switch 18
Conductor connection element 19
Conductor insertion opening 20
First function shaft 21
Second function shaft 22
Plug-in connection receiving region 23*a*, 23*b*
Screw-connection receiving region 24
Partition plate 25
Edge 26
Edge 27
Lead-in chamfer 28
Guide groove 29
Plug-in direction 30
Plug-in bridge 31
Switching plug bridge 32
Test plug socket 33
Screw 34
Test socket screw 35
Switching screw bridge 36
Bridge comb 37

The invention claimed is:

1. A terminal strip for latching onto a mounting rail, the terminal strip comprising:

a terminal housing that has a first connection side and a second connection side;

a busbar arranged in the terminal housing; and at least two conductor connection elements arranged in the terminal housing, the conductor connection elements each being configured to connect at least one conductor to the busbar, each conductor connection element having a first function shaft having at least one plug-in connection receiving region and at least a second function shaft having at least one screw-connection receiving region arranged on each of the connection sides of the terminal housing, one connection region being formed for a respective plug-in connection receiving region and for a respective screw-connection receiving region in the busbar, wherein the function shafts of one connection side are arranged in a manner spaced apart from one another such that at least one plug connection is receivable in the first function shaft and at least one screw connection is receivable in the second function shaft simultaneously on one connection side.

2. The terminal strip according to claim 1, wherein, between the first function shaft and the second function shaft of a connection side, a partition plate is arranged at least transverse to a longitudinal extension of the terminal strip, the partition plate being mounted on an edge of the function shafts.

3. The terminal strip according to claim 2, wherein the partition plate has a lead-in chamfer.

4. The terminal strip according to claim 2, wherein the partition plate has a guide groove.

5. The terminal strip according to claim 2, wherein the partition plate is U-shaped.

6. The terminal strip according to claim 1, wherein the busbar comprises a first busbar portion assigned to the first connection side and a second busbar portion assigned to the second connection side, a longitudinal isolating switch being movably mounted between the two busbar portions in the terminal housing, the busbar portions being connected to one another in a first position of the longitudinal isolating switch and being separated from one another in a second position of the longitudinal isolating switch.

7. A terminal strip block, comprising:

at least two terminal strips latchable next to one another on a mounting rail, the at least two terminal strips being configured according to claim 1.

* * * * *